US005593295A

United States Patent [19]

Hill

[11] Patent Number: 5,593,295

[45] Date of Patent: Jan. 14, 1997

[54] SCROLL COMPRESSOR CONSTRUCTION HAVING AN AXIAL COMPLIANCE MECHANISM

[75] Inventor: Joe T. Hill, Bristol, Va.

[73] Assignee: Bristol Compressors, Inc., Bristol, Va.

[21] Appl. No.: 424,975

[22] Filed: Apr. 19, 1995

[51] Int. Cl.[6] ..... F04C 18/04; F04C 27/00

[52] U.S. Cl. ..... 418/55.2; 418/55.3; 418/55.4; 418/55.5; 418/57

[58] Field of Search ..... 418/55.2, 55.3, 418/55.4, 55.5, 57

[56] References Cited

U.S. PATENT DOCUMENTS

| | | | |
|---|---|---|---|
| 3,600,114 | 8/1971 | Dvorak et al. | 418/55.5 |
| 4,993,928 | 2/1991 | Fraser, Jr. | 418/55.5 |
| 5,088,906 | 2/1992 | Richardson, Jr. | 418/55.5 |

FOREIGN PATENT DOCUMENTS

| | | | |
|---|---|---|---|
| 59-79091 | 5/1984 | Japan | 418/55.5 |

*Primary Examiner*—John J. Vrablik

[57] ABSTRACT

A scroll compressor having a housing, a fixed scroll and an orbiting scroll nested with each other to provide a pressure continuum of suction, intermediate and high pressure regions between said scrolls during compressor operation, the base of the orbiting scroll being axially slidably mounted on a thrust plate for allowing only axial motion of the orbiting scroll with respect thereto, a coupling device on the housing or fixed scroll and associated with cooperating coupling elements on one or both of the thrust plate or the orbiting scroll for preventing angular motion of the orbiting scroll with respect to the housing or fixed scroll, an axial compliance seal between and contacting the base of the orbiting scroll and the thrust member and defining an axial compliance pressure chamber, and one or more conduits connecting the chamber with one or more pressure regions.

2 Claims, 2 Drawing Sheets

SCROLL COMPRESSOR CONSTRUCTION HAVING AN AXIAL COMPLIANCE MECHANISM

FIELD OF INVENTION

This invention concerns scroll compressors such as employed in air conditioning and refrigeration systems, and particularly concerns novel structure and arrangement of structural elements including the scrolls themselves, their axial compliance mechanism, the mounting structure for the orbiting scroll, and the axial compliance sealing means.

BACKGROUND OF THE INVENTION

In scroll compressors it is necessary or at least highly desirable to provide an axial compliance mechanism which effects proper sealing of the wrap tips against the adjacent scroll base even though pressures of several hundred psi are typically developed in the pressure continuum, i.e., the compression pockets which are continuously formed, compressed, discharged and reformed between the scrolls. This mechanism, most often comprises an axial compliance pressure chamber which is sealed to ambient pressures by one or more annular, elastomeric seals which bear and seal against portions of the orbiting scroll base and fixed portions of the compressor housing. This sealing structure necessarily requires an orbital rubbing of the seal against at least one of these structures. The said pressure chamber is designed to communicate with an intermediate pressure region of said continuum and thereby exert forces against the axially outer surface, i.e., low pressure side of the base of the orbiting scroll to significantly counteract the axial forces generated in the pressure continuum which tend to axially separate the scrolls. One of the greatest difficulties encountered with the use of such a chamber is the problem of maintaining its seal during the axial compliance and orbital movements of the scroll over the enormous number of orbital cycles of the compressor during its lifetime.

Also, in scroll compressors, the high pressure pockets of the pressure continuum are typically responsible for imparting strong forces, i.e., tangential, radial, or lateral against the wrap of the orbiting scroll which tend to tip the scroll on its longitudinal axis. Such tipping-can place the chamber seal in alternating compressed and relaxed conditions, which, in combination with a simultaneous frictional, orbital sliding contact of the seal with metal can lead to premature failure of the seal and loss of sealing between the wrap walls and between each wrap tip and the juxtaposed base of the other scroll, and thus a reduction in compressor efficiency.

PRIOR ART

Heretofore, scroll compressors in which the orbiting scroll is mounted on the permanent, fixed housing for axial compliance movement typically involves fairly complex sealing means for the axial compliance pressure chamber as shown, e.g., in U.S. Pat. No. 4,938,669, and other types and Variations of sealing means for various compressor constructions are shown in U.S. Pat. Nos. 5,129,798; 4,877,382; 5,102,316; 5,088,906; 5,085,565; 5,082,432; 4,892,469; 4,600,369; 3,874,827; 4,767,293; and 5,295,813, the disclosures of which regarding the known and generally employed construction of compressor shell, motor, Oldham coupling, aspects of scroll construction and manufacture auxiliary to or other than that of the present invention, scroll drive structure such as eccentric mountings means and radial compliance devices, and the like, are hereby incorporated herein by reference, as being useful in manufacturing and/or use of the present invention. These prior sealing means, however, do not avoid the rubbing wear of the seal associated therewith in the very simplified and easy to manufacture manner of the present invention.

Objects, therefore, of the present invention are: to provide novel scroll and axial compliance seal construction for the axially compliant orbiting scroll, which construction provides essentially static sealing means-and thus essentially eliminates seal wear; to provide such seal construction which markedly increases seal life and minimizes the degree of scroll machining and modification necessary for utilizing the present invention; to provide such seal construction which essentially maintains the compression efficiency of the scrolls during axially compliant and orbital movement of the orbiting scroll; and to provide such scroll construction which is adaptable to a wide variety of scroll compressor constructions.

BRIEF SUMMARY OF THE INVENTION

These and further objects hereinafter appearing have been attained in accordance with the present invention which, in a preferred embodiment is defined as a scroll compressor having a housing means with a longitudinal axis, a non-orbiting scroll means formed integrally with and comprising a portion of said housing means or provided as a separate structural element and fixed in position angularly, radially and axially on said housing means, an orbiting scroll means, each of said scroll means having a base means formed with a free side and a pressure side and a wrap extending outwardly from said pressure side, each said wrap terminating outwardly in a generally spiroid shaped wrap tip, said wraps being nested within each other such that each said tip lies adjacent the pressure side of the mating scroll base means, a crankshaft axially mounted in said housing means and having an eccentric thereon for driving said orbiting scroll through an orbit, thrust plate means having a pressure side and a free side, said orbiting scroll means being mounted on said thrust plate means for only axial motion with respect thereto, said eccentric of said compressor crankshaft being rotatably mounted on said low pressure side of said thrust plate means for providing orbital motion to said thrust plate means and said orbiting scroll means about said longitudinal axis of said compressor to produce a pressure continuum between said scroll wraps and scroll base means, the free side of said base means of said orbiting scroll means providing a first thrust surface means juxtaposed a second thrust surface means formed on said pressure side of said thrust plate means, said first and second thrust surface means being cooperatively configured to provide axial compliance pressure chamber means therebetween, passage means formed through said base means of said orbiting scrorl means and placing said chamber means in fluid communication with an intermediate region of said pressure continuum for providing axial compliance forces directed against said first thrust surface means of said orbiting scroll means and urging the wrap tip thereof toward sealing engagement with the adjacent base means of said non-orbiting scroll means, and annular axial compliance seal means in said chamber means and defining the radially outer periphery thereof and making sealing contact with portions of said free side of said base means of said orbiting scroll means and with portions of said pressure side of said thrust plate means to seal said chamber means against ambient pressures.

In certain preferred embodiments:

(a) the axial compliance seal means comprises an annular flexible seal having an annular central web portion integral with a pair of radially inner and outer concentric, peripheral rim means, one of which rim means sealingly contacts annular shoulder means on said free side of said base means of said orbiting scroll means and the other of which rim means sealingly contacts annular shoulder means on said pressure side of said thrust plate means, said web portion being sufficiently flexible and resilient to allow relative axial motion of said rim means as said non-orbiting scroll means moves axially during axial compliance;

(b) each said shoulder means comprises an annular wall surface which is substantially axially oriented;

(c) at least a portion of said free side of said thrust plate means provides a planar, annular first bearing surface means, and said housing means provides a planar, annular second bearing surface means for slidably contacting said first bearing surface means and axially supporting said thrust plate means and said orbiting scroll means;

(d) said base means of said orbiting scroll means and said thrust plate means are provided with cooperating elements of a guide means comprising a combination of axially oriented shoulder means, said combination being selected from the group consisting of key and keyway means, or posts and sleeve means, said combination allowing axial compliance motion of said orbiting scroll means relative to said thrust plate means without allowing relative angular motion therebetween; and (e) the structure of (d) above wherein said base means of said orbiting scroll means and said thrust plate means are provided with stabilizer means comprising annular groove means provided in one of said first or second thrust surface means, and mating annular ridge means provided on and projecting outwardly from the other of said first or second thrust surface means, said stabilizer means functioning to prevent radial or lateral relative motion between said orbiting scroll means and said thrust plate means.

BRIEF DESCRIPTION OF THE DRAWINGS

The invention will be further understood from the drawings herein of certain preferred embodiments and the following description thereof wherein certain dimensions and wall thickness have been exaggerated for clarity.

DETAILED DESCRIPTION OF THE DRAWINGS

Figure 1:
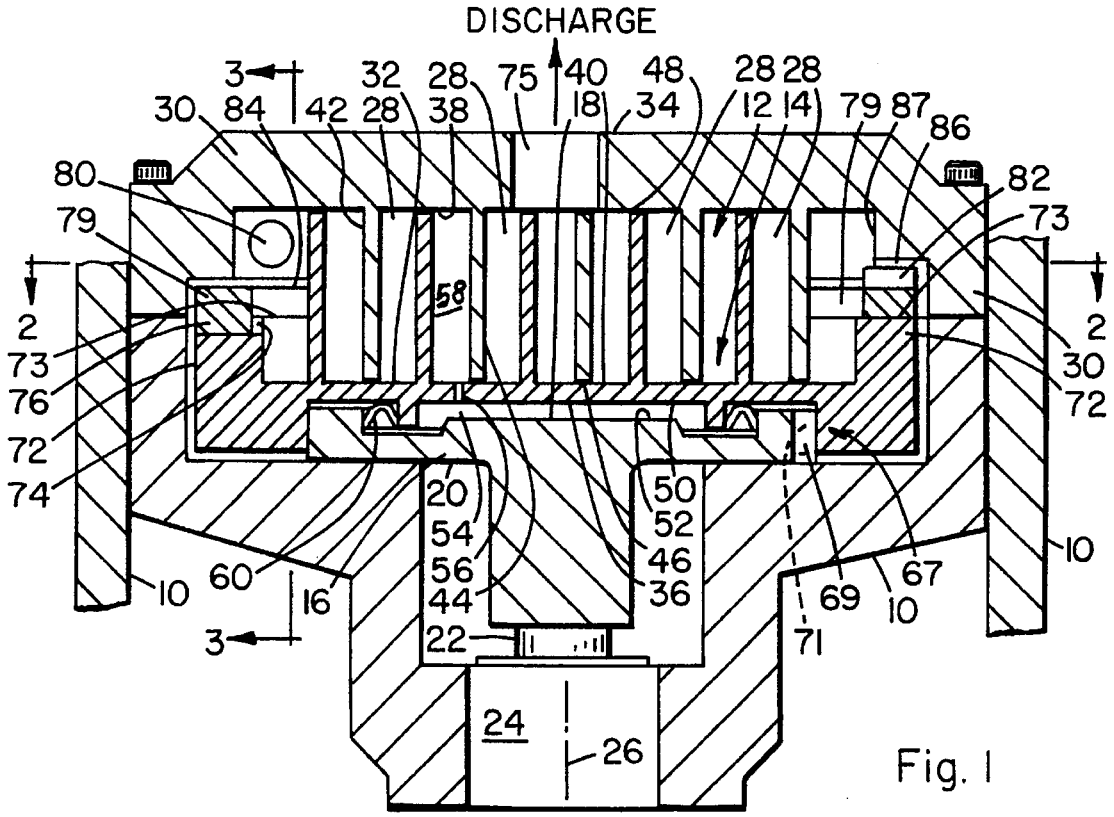
FIG. 1 is a longitudinal cross-sectional view taken along line 1—1 of FIG. 2 of the scroll area of a compressor embodying the present invention.

Referring to the drawings and with reference to the claims hereof, the present scroll compressor comprises a housing means 10 which comprises the fixed or stationary portion of the compressor, a non-orbiting scroll means 12 formed integrally with and comprising a portion of said housing means or provided as a separate structural element and fixed in position angularly, radially and axially on said housing means, said non-orbiting scroll means hereinafter coming within the term "housing means", an orbiting scroll means 14 nested with said non-orbiting scroll means, guide means generally designated 67 mounting said orbiting scroll means on thrust plate means 16 for only axial motion with respect thereto, said thrust plate means having a pressure side 18 and a free side 20, axial motion coupling means such as an Oldham coupling ring generally designated 79 keyed on said housing means and on one or both of said thrust plate means or said orbiting scroll means for allowing only radial orbital motion of said orbiting scroll with respect to said housing means, the eccentric 22 of the compressor crankshaft 24 being rotatably mounted on said free side of said thrust plate means for providing orbital motion to said thrust plate means and said orbiting scroll means about the longitudinal axis 26 of the compressor to produce a pressure continuum of suction, intermediate, and high pressure regions generally designated 28 between said scroll wraps and said bases, discharge port means 75 in said housing means communicating with said high pressure region, suction port means 80 in said housing means communicating with said suction pressure region, each of said scroll means having a base means 30, 32 respectively, formed with a free side 34, 36 respectively, and a pressure side 38, 40 respectively, and a wrap 42, 44 respectively extending outwardly from said pressure side, each wrap terminating outwardly in a generally spiriod shaped wrap tip 46, 48 respectively, an annular portion of the free side of said base means of said orbiting scroll means having a first thrust surface means 50 being juxtaposed a second thrust surface means 52 formed on said thrust plate means, said first and second thrust surface means being cooperatively configured to provide axial compliance pressure chamber means 54 therebetween, passage means 56 formed through said base means of said orbiting scroll means and placing said chamber means in fluid communication with a region such as 58 of said pressure continuum for providing an axial compliance force against said free side of said orbiting scroll means and urging the orbiting wrap tips thereof toward sealing engagement with the adjacent base means of said non-orbiting scroll means, and perimetric, i.e., any continuous or substantially continuous configuration, axial compliance seal means 60 in said chamber means and making sealing contact with portions of said free side of said base means of said orbiting scroll means and portions of said pressure side of said thrust plate means for sealing said chamber means against ambient pressures.

Figure 4:
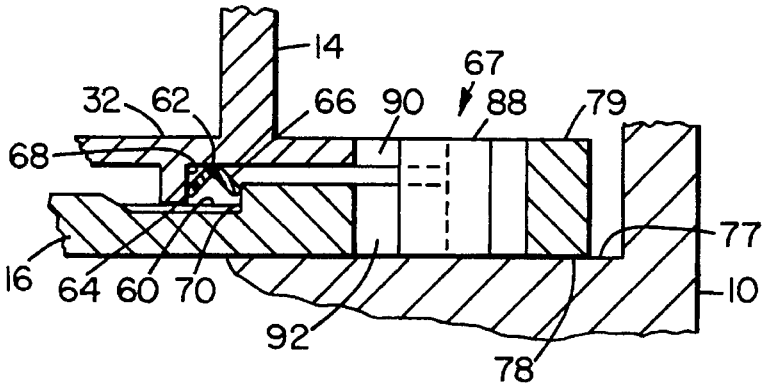
FIG. 4 is a cross-sectional view of a variation of the coupling means and key and keyway means.

As shown in enlarged detail in FIG. 4, the seal means 60 may be of any configuration but preferably comprises an annular flexible seal member having an annular central web portion 62 provided with a pair of radially inner 64 and outer 66 concentric peripheral rims, the inner one of which sealingly contacts an annular shoulder 68 on said free side of said base means of said orbiting scroll and the other of which sealingly contacts annular shoulder means 70 on said pressure side of said thrust plate means, said web portion being sufficiently flexible and resilient to allow relative axial motion of said rims as said non-orbiting scroll axially moves during axial compliance.

The base 32 of the orbiting scroll is axially movably mounted on the thrust plate means by any suitable guide means 67, however, the embodiment shown in FIG. 1 is preferred. In this embodiment the scroll base means 32 is provided with an annular rim means 72 which is provided on its inner periphery with any suitable number of keyways 71 in which projections or keys 69 on said thrust plate slide to provide for the axial compliance motion of the orbiting scroll means. In this embodiment, rim means 72 is further provided with slots or keyways 74 which slidably receive the projections or keys 76 extending downwardly from an Oldham ring 79 for allowing radial but not angular movement of scroll means 14 with respect to ring 79. This ring is further provided with projections or keys 82 extending, e.g., from the upper side 84 thereof and which are slidably received in keyways 86 formed, e.g., in the inner surface 87 of the fixed scroll base means 30 and allowing radial but not angular movement of ring 79 with respect to fixed scroll means 12 and the compressor housing. Such radial movements of ring 79 will allow only orbiting movement of scroll means 14 with respect to scroll means 12.

Figure 2:
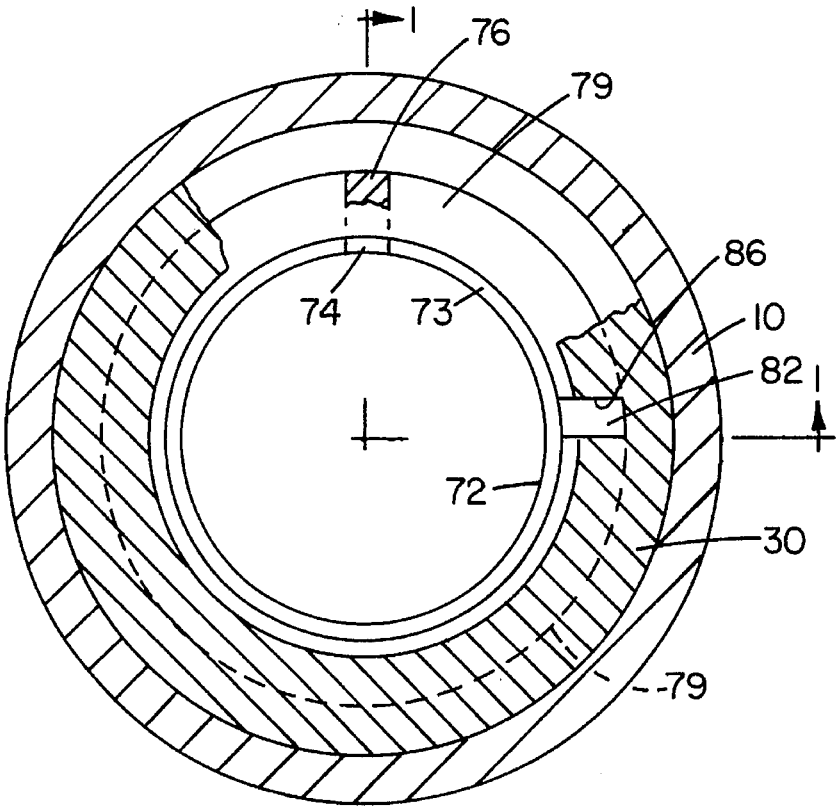
FIG. 2 is a cross-sectional view taken along line 2—2 of FIG. 1 in the direction of the arrows but not showing the scroll wraps.
Figure 3:
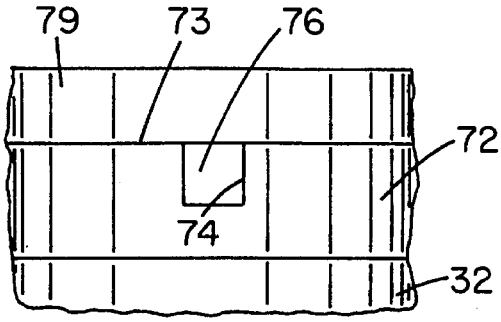
FIG. 3 is an enlarged cross-sectional view taken along line 3—3 of FIG. 1 in the direction of the arrows and showing portions of Oldham ring and adjacent rim of the orbiting scroll.

Referring further to FIG. 4 wherein structures which are substantially equivalent to that in FIGS. 1 and 2 are numbered the same, the Oldham ring 79 has been modified to provide axially enlarged keys 88 on its inner periphery which are radially slidable in both slots 90 and 92 provided respectively in the peripheries of scroll base 32 and thrust plate means 16 such that separate structural combinations such as keys 76 and keyways 74 can be eliminated. In this embodiment, keyways and keys equivalent to 86 and 82 may be provided respectively, e.g., in directly radially opposed upper portions 77 of the housing means 10 and on directly radially opposed lower portions 78 of the Oldham ring, pairs of said keyways and keys being in alignment for allowing said radial sliding motion of said ring.

Figure 5:
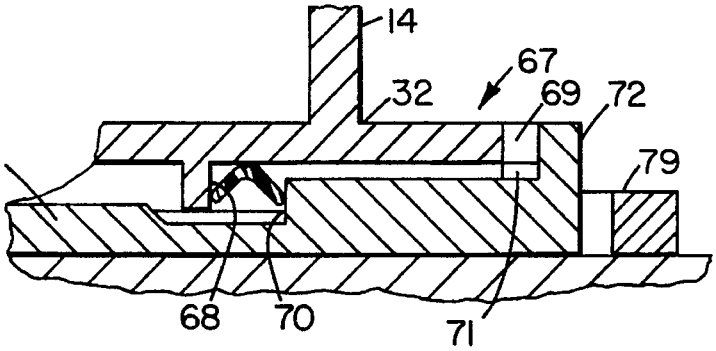
FIG. 5 is a cross-sectional view of a further variation of the key and keyway means.

Referring to FIG. 5, the rim means 72 is provided on the thrust plate means rather than the orbiting scroll means base 32, and thus the Oldham ring can be-slidably mounted on this rim of the thrust plate means in accordance with any of the embodiments shown herein for mounting of said ring to said scroll means base.

Figure 6:
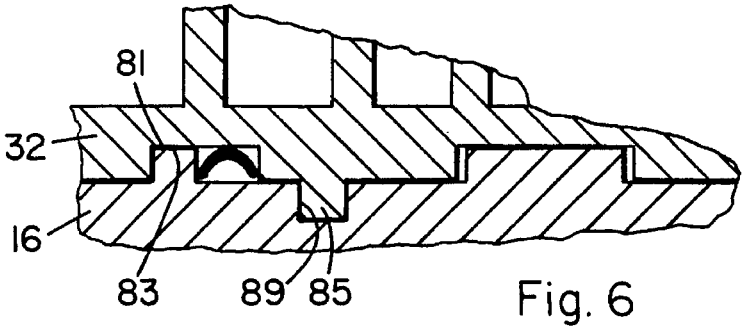
FIG. 6 is a cross-sectional view of portions of said orbiting scroll means and said thrust plate means showing guide means for allowing prescribed motion therebetween.

Referring to FIG. 6, thrust plate 16 is provided with a perimetric chine or ridge means 81, preferably continuous and substantially annular in shape and which closely fits within substantially the same shaped mating groove means 83 in scroll base means 32. In this embodiment, it is also preferred to provide, e.g., two or more, preferably three, posts 85 symmetrically angularly spaced around base means 32, and equally spaced recesses or sleeves 89 in the thrust plate means closely fitting with said posts. Such a combination provides for the necessary angular alignment of the scroll means and thrust plate means via said posts and sleeves, and for a greatly enhanced resistance to relative radial motion between the scroll means and thrust plate means. The structure of FIG. 6 may, of course be utilized in any of the other embodiments shown herein.

The invention has been described in detail with particular reference to preferred embodiments thereof, but it will be understood that variations and modification will be effected with the spirit and scope of the invention.

I claim:

1. A scroll compressor having housing means, a fixed scroll on said housing means and an orbiting scroll nested therewith and providing for suction, intermediate, and high pressure regions during compressor operation, base means on said orbiting scroll, thrust plate means axially slidably mounted on said base means of said orbiting scroll by guide means, cooperating elements of coupling means on said fixed scroll and on one or both of said thrust plate means or said orbiting scroll for allowing axial motion while preventing angular motion of said orbiting scroll with respect to said fixed scroll, perimetric configured axial compliance seal means positioned between and contacting said base means of said orbiting scroll and said thrust plate means and defining thereby an axial compliance pressure chamber means, and conduit means connecting said chamber means with one or more desired ones of said pressure regions, said guide means comprises cooperating structural elements selected from the group consisting of (a) key and keyway means, (b) posts and sleeve means, (c) perimetric chine and groove means, and (d) a combination of any of (a), (b) or (c), said guide means allowing axial compliance motion of said orbiting scroll means relative to said thrust plate means without allowing relative angular motion therebetween, and wherein said guide means constitutes a segment of said coupling means.

2. A scroll compressor comprising housing means providing a non-orbiting scroll means, an orbiting scroll means nested with said non-orbiting scroll means, each of said scroll means having a base means formed with a free side and a pressure side and a wrap extending outwardly from said pressure side, each said wrap terminating outwardly in a generally spiroid shaped wrap tip, a crankshaft axially mounted in said housing means and having an eccentric thereon for driving said orbiting scroll means through an orbit, thrust plate means having a pressure side and a free side and being mounted between said base means of said orbiting scroll means and portions of said housing means whereby said pressure side of said thrust plate means lies adjacent said free side of said base means of said orbiting scroll means, cooperating elements of guide means on said orbiting scroll means and on said thrust plate means for allowing only relative axial motion therebetween, said guide means being selected from the group consisting of (a) key and mating keyway means, (b) posts and mating sleeve means, (c) perimetric chine and mating groove means, and (d) a combination of any of (a), (b) or (c), said guide means allowing axial compliance motion of said orbiting scroll means relative to said thrust plate means without allowing relative angular motion therebetween, and wherein said guide means constitutes a segment of said coupling means, coupling means on said housing means and associated with cooperating coupling means on one or both of said thrust plate means or said orbiting scroll means for allowing axial but preventing angular motion of said orbiting scroll means with respect to said housing means, and wherein said guide means constitutes a segment of said coupling means, said eccentric of said compressor crankshaft being rotatably mounted on said free side of said thrust plate means for providing orbital motion to said thrust plate means and thus to said orbiting scroll means about the longitudinal axis of the compressor to produce a pressure continuum of suction, intermediate, and high pressure regions between said scroll wraps and said base means, discharge port means in said housing means communicating with said high pressure region, suction port means in said housing means communicating with said suction pressure region, the free side of said base means of said orbiting scroll means providing a first thrust surface means juxtaposed a second thrust surface means formed on said pressure side of said thrust plate means, said first and second thrust surface means being cooperatively configured to provide an axial compliance pressure chamber means therebetween, passage means formed through said base means of said orbiting scroll means and placing said chamber means in fluid communication with one or more regions of said pressure continuum for providing an axial compliance force directed against said first thrust surface means of said orbiting scroll means for urging said orbiting scroll means axially toward said non-orbiting scroll means and thereby urging the wrap tip of each said scroll means toward sealing engagement with the adjacent base means of the other scroll means, and axial compliance seal means in said chamber means and defining the outer periphery thereof and making sealing contact with portions of said free side of said base means of said orbiting scroll means and with portions of said pressure side of said thrust plate means to seal said chamber means against ambient pressures.

* * * * *